US005753401A

United States Patent [19]

Woytek et al.

[11] Patent Number: 5,753,401

[45] Date of Patent: May 19, 1998

[54] MULTIACTIVE ELECTROSTATOGRAPHIC ELEMENTS HAVING A SUPPORT WITH BEADS PROTRUDING ON ONE SURFACE

[75] Inventors: David Michael Woytek, Rochester; Douglas Edward Garman, Webster, both of N.Y.

[73] Assignee: Eastman Kodak Company, Rochester, N.Y.

[21] Appl. No.: 585,326

[22] Filed: Jan. 11, 1996

[51] Int. Cl.[6] ..... G03G 5/00; G03G 5/10

[52] U.S. Cl. ..... 430/133; 430/127; 430/128; 430/58; 430/59; 430/63; 430/69

[58] Field of Search ..... 430/63, 69, 57, 430/58, 59, 128, 133, 127

[56] References Cited

U.S. PATENT DOCUMENTS

| | | | |
|---|---|---|---|
| 4,175,960 | 11/1979 | Berwick et al. | 430/58 |
| 4,551,406 | 11/1985 | Schaedlich et al. | 430/56 |
| 4,732,834 | 3/1988 | Honda et al. | 430/57 |
| 5,021,309 | 6/1991 | Yu | 430/58 |
| 5,190,608 | 3/1993 | Darcy et al. | 156/73.4 |
| 5,213,928 | 5/1993 | Yu | 430/66 |
| 5,238,763 | 8/1993 | Sullivan et al. | 430/58 |
| 5,283,143 | 2/1994 | Yanus et al. | 430/59 |
| 5,310,613 | 5/1994 | Pai et al. | 430/59 |

FOREIGN PATENT DOCUMENTS

| | | |
|---|---|---|
| 453579 | 10/1991 | European Pat. Off. . |
| 3-063658 | 3/1991 | Japan . |

OTHER PUBLICATIONS

Patent & Trademark Office English–Language Translation of JP 3–63658 (Pub. Mar. 1991).

Patent Abstracts of Japan English–Language Abstract of JP 63–32155 (Pub. Dec. 1994).

*Primary Examiner*—Janis L. Dote

*Attorney, Agent, or Firm*—John R. Everett

[57] ABSTRACT

A method of making a multiactive photoconductive elements is disclosed. The method uses a knurl free planar polymeric support having beads protruding from one surface. An element comprising such supports is also disclosed.

21 Claims, No Drawings

MULTIACTIVE ELECTROSTATOGRAPHIC ELEMENTS HAVING A SUPPORT WITH BEADS PROTRUDING ON ONE SURFACE

FIELD OF THE INVENTION

This invention relates to electrophotography.

BACKGROUND OF THE INVENTION

Multiactive electrophotoconductive elements are known. In general such elements comprise a conductive support in electrical contact with a charge generation layer and a charge transport layer. Methods and materials for making these elements are described in many patents such as U.S. Pat. Nos. 3,615,414; 4,175,960 and 4,082,551. Methods for using these elements are also described in these patent publications.

In one commercial method for preparing multiactive elements a roll of polymer support, of non-standard width and several thousand meters long, is slit, and at the same time knurled to a greater thickness. The width of the rolls are non-standard in that the widths required by this method must be specially made. In this step knurls are placed in the center and along the edges of the slit support. Knurling involves the application of rollers to the support. The rollers have a relief or embossed pattern thereby creating a relief pattern in portions of the support to which the rollers are applied. Knurls in the support assist in providing the slip needed to transport the support, and any layers thereon, over rollers and flat surfaces. Knurls also enable the support to be wound into rolls especially during vacuum coating operations.

The slit and knurled support is coated with a metal layer in a vacuum chamber and then slit again. A charge transport layer is solvent coated directly on the metallized support. A charge generation layer is then solvent coated over the charge transport layer. A hard overcoat layer may be solvent coated over the charge generation layer. A final slitting step is required to remove portions of the element containing knurled support. Subsequently this element is cut into smaller commercial lengths. These smaller elements are stacked in trays. Interleaving sheets are inserted between elements. The stacks of smaller elements are then cured in an oven. The interleaving sheets permit gases to escape between the sheets, reduce static attraction and allow slippage to accomodate movement of the elements as they cure.

Other steps in manufacturing the multiactive element may include perforating and slitting the element to commercial widths.

This method of manufacture involves several disadvantages. The support must be wide enough to accommodate the width of the final multiactive element and the width of knurled portions. Since the knurled portions of the support are ultimately discarded, waste and increased cost are incurred. The thicker element created by knurling also limits the length of support that can be coated with a metal layer in one batch in the vacuum coating chamber. Also the initial slitting step is required because of the non-standard width required in the starting support.

The need to insert interleaving sheets between the stacked smaller elements creates additional disadvantages resulting from the cost of the interleaving material, time required to produce it and the additional manufacturing step of inserting and removing it between elements in the stacks. The interleaving material is also a source of contamination. When dirty interleaving sheets are placed in contact with the smaller elements the dirt is transferred to the sheet and is embedded into the film surface under the heat and pressure of the baking stack. This embedded dirt can cause copy artifacts. The interleaving also takes up room in the tray that could otherwise be used for the smaller units of the multiactive elements.

SUMMARY OF THE INVENTION

The present invention provides a method of making a multiactive photoconductive element; said method comprising the steps of:

A. providing a roll multiactive photoconductive element by
   i. providing a knurl free roll of a planar polymeric support having beads protruding from one surface;
   ii. vacuum coating a metal on the support surface opposite the surface bearing the beads;
   iii. solvent coating a charge transport layer on the metal layer;
   iv. applying a charge generation layer on the charge transport layer and
   v. coating a carbon layer along the edge of the charge transport layer, thereby forming a roll of multiactive photoconductive element;

B. slitting the long photoconductive elements into smaller multiactive photoconductive element;

C. arranging the smaller multiactive photoconductive elements in stacks wherein each such element in a particular stack is in direct contact with adjacent elements in that stack D. curing the stacks of smaller planar units.

Use of planar supports having beads protruding from the surface opposite the metal coated layer eliminates the need for knurling, the first slitting step, the need to use nonstandard polymeric support widths and the interleaving sheets during the curing step. Also elimination of knurling increases the length of polymer support that can be metal coated in a single vacuum coating operation.

The method of the invention further provides a multiactive electrophotographic element comprising a support bearing, in the following order, a metal layer, a charge transport layer and a charge generation layer characterized in that the support has beads protruding from the surface opposite the surface upon which the conducting layer resides.

DETAILS OF THE INVENTION

An essential requirement of the present invention is use of planar polymeric supports having beads protruding from at least one surface. A wide variety of polymers are used as supports in the electrophotographic arts. Such polymers are disclosed, for example in U.S. Pat. Nos. 4,082,551 and 4,175,960 and the other patents and literature mentioned therein.

The beads are added to the entire cross section of the support, or alternately, to a thin, co-extruded layer on one side of the support. The beads protrude from the intended back surface 0.1 to 4.0 microns preferably 0.1 to 2.0 microns, and more preferably 0.1 to 1.0 microns. These protruding beads provide sufficient separation to allow the support, and any layers thereon, to slip against itself when wound into rolls or moved across large flat surfaces. The separation reduces the propensity of the support to static charge when being unwound from rolls or transported against static-inducing surfaces, such as plush materials used to prevent film scratching.

If it is assumed that beads protrude only 50% or less, then bead size should be limited to 0.5 to 8.0 microns. More protrusion can result in vacuum coating or solvent coating difficulties. Shape of the beads can also have an impact on allowable protrusion. Round beads or slightly flattened beads having minimal effect on coating operations. When extruded in the polymer, and protruding only 50% of their diameter, such beads tend to be effectively attached to the film base. Dusting and contamination from dislodged beads is avoided. Bead protrusion of no more than 3–4 microns also avoids contamination and conveyance issues associated with larger beads. The number of beads present in the support is at least 50 parts of beads per million parts of support. This level of bead content ensures the minimum number of protruding beads on at least one surface.

In processes using rear exposure or erase, haze should be kept below 4.0% to avoid unwanted attenuation of the light source. Glass can be used because its index of refraction is similar to that of the preferred polymer supports. The use of glass allows a relatively heavy loading of bead material in the copolymer resin without producing unacceptable haze. This is important when the beads are uniformly distributed through the entire cross section of the film base. Polymer beads can also be used because of the similarity of index of refraction. Silica beads are very tough, but can produce unacceptable haze at very low loadings. However, heavier loadings of large silica beads can be used if the beads are restricted to only a portion of the film's cross section, such as afforded by the use of the thin coextruded layer mentioned above.

Useful planar support polymers include biaxially oriented polyethyleneterephthalate (PET) and polyethylenenaphthalate (PEN). Polyethyleneterephthalate containing beads protruding from one surface is available commercially from ICI under the trade name Melinex™. These supports are available in rolls having a standard width of 44 inches and a variety of lengths.

Next the rolled planar polymeric support is coated with a metal layer in a vacuum chamber to form a conducting support. Vacuum deposited metal layers, such as silver, nickel, chromium, titanium, aluminum and the like are useful. Vacuum coated metal layers are known from the patent publications referred to previously. Conducting materials such as nickel can be vacuum deposited on transparent film supports in sufficiently thin layers to allow electrophotograhic layers prepared therefrom to be exposed through the transparent film support if so desired.

A supply roll of the planar support used in the invention is loaded into the vacuum chamber of a vacuum coating machine. The air is then evacuated therefrom. A metal, preferably nickel, is vaporized in an enclosure within the chamber. The support is unwound from the supply roll, conveyed across an aperture in the top of the vaporization enclosure, and wound onto a takeup roll. As the support is transported past the aperture, the metal, preferably is deposited on the surface of the support opposite the bead bearing surface. This metal layer becomes the grounding layer for the subsequently coated charge transport and charge generating layers.

Transport, in a vacuum, of a smooth, compliant support that comes in close contact with itself or other smooth surfaces is difficult. Such surfaces tends to block or stick together. This makes it difficult to wind or steer the support when transporting or winding onto rolls. The support used in the invention eliminates these difficulties. Moreover the support, without knurls is thinner. This means that larger and longer rolls of the support can be metallized in a single vacuum metallizing operation.

The charge transport layer is solvent coated on the metal coated support prepared according to the above vacuum coating procedure. Because many, if not most, conventional organic photoconductor-containing compositions are preferably coated using organic solvent vehicles, organic solvent coating on a commercial scale is much practiced in this art.

The charge generation layer is applied on the charge transport layer. The method of application will depend in part on the charge generating material use in the layer. For example vacuum deposition of perylene pigments can be carried out. In many cases solvent coating will be useful as is the case for charge transport layers.

Various coating solvents for preparing multiactive elements compositions useful in the present invention include: aromatic hydrocarbons such as benzene, including substituted aromatic hydrocarbons such as toluene, xylene, mesitylene, etc.; ketones such as acetone, 2-butanone, etc.; halogenated aliphatic hydrocarbons such as methylene chloride, chloroform, ethylene chloride; ethers including cyclic ethers such as tetrahydrofuran, diethyl ether; and mixtures of the foregoing.

The compositions of both charge transport layers and charge generation layer are well known. Again information sufficient for one skilled in the art is provided by the literature already cited herein. Such "multiactive" photoconductive compositions contain a charge-generation layer in electrical contact with a charge-transport layer. The charge-generation layer of such a "multiactive" composition comprises a multiphase "aggregate" composition as described hereinabove. The charge-transport layer of such "multiactive" compositions comprises an organic photosensitive charge-transport material such as described in the aforementioned patent, for example, a p-type organic photoconductor such as the arylamine, polyarylalkane and pyrrole materials noted earlier herein in U.S. Pat. No. 4,062,681.

Coatings were applied to the metal coated support with a solvent coating machine. Such machines are commercially available. With the machine used in this invention three uniform layers were coated in one pass. Coating and drying characteristics were controlled to avoid coating artifacts. The charge transport layer (CTL), was applied at the first coating station. A carbon layer was also coated at the first station along the edges of the CTL. The latter layer extended to the metal layer. The charge generation layer (CGL) was applied over the CTL. Generally a smooth overcoat is coated over the charge generation layer.

The result of the preceding step is a long roll of a planar multiactive electrophotographic element. The latter element is cut into commercial length sheets. This cutting operation can be carried out using commercially available sheeting equipment. The beaded support used in the invention facilitates steering and web conveyance in sheeting equipment.

The commercial length sheets are stacked in trays and baked in an oven to stabilize and cure the solvent coated layers. During the curing process, solvents escape from the coated layers. With no separation between the sheets, the overcoat is too smooth and hard to permit the gases to escape between the sheets. The gases collect in pockets that result in deformities in the sheets. During the curing process, the support and coated layers expand and contract at different rates. With no separation of the sheets, the smooth overcoat and smooth support block or stick together. If the sheets are stuck together, the movement during curing results in small buckles and deformities in the sheets. These deformities can result in copy artifacts. In the prior art interleaving material was inserted between each sheet in a stack to avoid these problems. Such interleaving material was polymeric and coated on both sides with 8–10 micron beads in a binder. The beaded support used in the invention avoids the need for interleaving material between the sheets.

The invention has been described in detail with particular reference to preferred embodiments thereof, but it will be understood that variations and modifications can be effected within the spirit and scope of the invention.

We claim:

1. A method of making a multiactive photoconductive element; said method comprising the steps of:

A. providing a roll of multiactive photoconductive element by i. providing a knurl free roll of a planar polymeric support having beads protruding from at least one surface;

ii. vacuum coating a metal on the support surface opposite the surface bearing the beads;

iii. solvent coating a charge transport layer on the metal layer;

iv. applying a charge generation layer on the charge transport layer and v. coating a carbon layer along the edge of the charge transport layer, thereby forming a roll of multiactive photoconductive element;

B. slitting the roll of photoconductive element into smaller multiactive photoconductive elements;

C. arranging the smaller multiactive photoconductive elements in stacks wherein each such element in a particular stack is in direct contact with adjacent elements in that stack D. curing the stacks of smaller planar units.

2. The method of claim 1 wherein the beads protrude from 0.1 to 4.0 microns from the surface of the support.

3. The method of claim 2 wherein the beads protrude from the surface of the support 0.1 to 2.0 microns.

4. The method of claim 1 wherein nickel is the vacuum coated metal.

5. The method of claim 1 wherein the support is biaxially oriented polyethyleneterephthalate or polyethylenenaphthalate.

6. The method of claim 5 wherein the support is biaxially oriented polyethyleneterephthalate.

7. The method of claim 1 wherein the beads have a size in the range 0.5 to 8.0 microns.

8. The method of claim 1 wherein the number of beads present is at least 50 parts of beads per million parts of support.

9. The method of claim 1 wherein the planar polymeric support has not been previously slit.

10. The method of claim 1 wherein the charge generation layer is solvent coated on the charge transport layer.

11. The method of claim 1 wherein the carbon layer is coated along the edge of the charge transport layer that extends to the metal layer.

12. A multiactive electrophotographic element comprising a support bearing, in the following order, a metal conducting layer, a charge transport layer and a charge generation layer characterized in that the support comprises beads in its entire cross section and said beads protrude from the surface opposite the surface upon which the metal conducting layer resides.

13. The element of claim 12 wherein the beads protrude from 0.1 to 4.0 microns from the surface of the support.

14. The element of claim 13 wherein the beads protrude from the surface of the support 0.1 to 2.0 microns.

15. The element of claim 12 wherein the support is biaxially oriented polyethyleneterephthalate or polyethylenenaphthalate.

16. The element of claim 15 wherein the support is biaxially oriented polyethyleneterephthalate.

17. The element of claim 12 wherein the beads have a size in the range 0.5 to 8.0 microns.

18. The element of claim 12 wherein the number of beads present is at least 50 parts of beads per million parts of support.

19. The element of claim 12 wherein a smooth overcoat resides over the charge generation layer.

20. The element of claim 12 wherein the metal conducting layer comprises nickel.

21. The element of claim 14 wherein a carbon layer is coated along the edge of the charge transport layer that extends to the metal layer.

* * * * *